US010746514B1

(12) United States Patent
Stacy

(10) Patent No.: US 10,746,514 B1
(45) Date of Patent: Aug. 18, 2020

(54) BROADHEAD ARROW TIP WITH INDEPENDENT SUSPENSION BLADES

(71) Applicant: Chase Kalieb Stacy, Oxford, IN (US)

(72) Inventor: Chase Kalieb Stacy, Oxford, IN (US)

( * ) Notice: Subject to any disclaimer, the term of this patent is extended or adjusted under 35 U.S.C. 154(b) by 0 days.

(21) Appl. No.: 16/741,995

(22) Filed: Jan. 14, 2020

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583
See application file for complete search history.

(56) References Cited

U.S. PATENT DOCUMENTS 2,568,417 A 9/1951 Steinbacher
4,932,671 A 6/1990 Anderson, Jr.
5,102,147 A 4/1992 Szeluga
5,458,341 A 10/1995 Forrest et al.
5,564,713 A 10/1996 Mizek et al.
5,857,930 A * 1/1999 Troncoso ..... F42B 6/08 473/583
6,077,179 A * 6/2000 Liechty, II ..... F42B 6/08 473/582
6,171,206 B1 * 1/2001 Liechty, II ..... F42B 6/08 473/583
6,287,224 B1 * 9/2001 Liechty, II ..... F42B 6/08 473/583
6,322,464 B1 * 11/2001 Sestak ..... F42B 6/08 473/583
6,428,434 B1 * 8/2002 Liechty, II ..... F42B 6/08 473/583
6,540,628 B1 * 4/2003 Musacchia, Jr. ..... F42B 6/08 473/583
7,377,869 B2 * 5/2008 Wohlfeil ..... F42B 6/08 473/583
8,016,704 B1 * 9/2011 Vandewater ..... F42B 6/08 473/583
8,113,974 B1 * 2/2012 Ward, Jr. ..... F42B 6/08 473/583
8,128,521 B1 * 3/2012 Ulmer ..... F42B 6/08 473/583
8,182,378 B1 * 5/2012 Futtere ..... F42B 6/08 473/583
8,398,510 B1 * 3/2013 Mizek et al. ..... F42B 6/08 473/583
8,449,415 B2 * 5/2013 Grace ..... F42B 6/08 473/583

(Continued)

*Primary Examiner* — Alexander R Niconovich
(74) *Attorney, Agent, or Firm* — Derek Pressley

(57) ABSTRACT

A broadhead arrow tip with independent suspension expandable blades is disclosed. It has an elongated ferrule body with a first slot oriented lengthwise therein which bifurcates the front end into two portions. A second slot oriented lengthwise within the body is situated between the first slot and the body's back end. The second slot is open to the body's side surfaces and is transversely wider than the first. Expandable blades are independently suspended within the second slot by a retaining pin passing through oblong apertures through an end of the blades. The blade ends have a thickness of one-third or less than the transverse width of the second slot. A threaded tip is securable on a threaded surface at the body's front end. Securement of the tip deflects the front portions toward one another, narrowing the first slot which holds the blades in a stowed positioned when placed therein.

1 Claim, 9 Drawing Sheets

(56) References Cited

U.S. PATENT DOCUMENTS

| | | | | |
|---|---|---|---|---|
| 8,512,179 | B2 * | 8/2013 | Pulkrabek | F42B 6/08 473/583 |
| 9,526,234 | B2 * | 12/2016 | Harshberger | A01K 81/00 |
| 9,683,819 | B2 * | 6/2017 | Buchanan | F42B 6/08 |
| 9,803,963 | B1 * | 10/2017 | Huang | F42B 6/08 |
| 9,857,153 | B1 * | 1/2018 | Redline | F42B 6/08 |
| 10,337,843 | B1 * | 7/2019 | Kinzer | F42B 6/08 |
| 10,458,767 | B2 * | 10/2019 | Buchanan | F42B 6/08 |
| 10,495,426 | B2 * | 12/2019 | Haas | F42B 6/08 |
| 2010/0113196 | A1 * | 5/2010 | Jones | F42B 6/08 473/583 |
| 2015/0168112 | A1 | 6/2015 | Hollars | |
| 2015/0354928 | A1 * | 12/2015 | Mizek | F42B 6/08 473/583 |
| 2017/0184381 | A1 | 6/2017 | Loa | |
| 2018/0245892 | A1 * | 8/2018 | Haas | F42B 6/08 |

* cited by examiner

BROADHEAD ARROW TIP WITH INDEPENDENT SUSPENSION BLADES

BACKGROUND OF THE INVENTION

This invention relates generally to archery, and more particularly to broadhead arrow tips with expandable blades for archery arrows.

Bow hunting has largely become a sport and less of a means for survival. With this mindset, bow hunters are becoming more conscious of humanely harvesting animals by shortening the time required for an animal to die as a result of being shot by an arrow. Arrowheads have advanced over the ages from merely a sharpened point at the end of the arrow's shaft, to separately attached fixed-blade arrowheads, and now to expandable broadhead arrow tips with movable blades which swing open upon impact. The patented prior art for expandable broadhead arrow tips reaches back at least as far as U.S. Pat. No. 2,568,417 to Steinbacher in 1951.

As was detailed in U.S. Pat. No. 8,128,521 issued in 2012 to Ulmer, said reference incorporated by reference in its entirety, the blades of expandable broadhead arrow tips generally become fixed with respect to the ferrule and are incapable of movement when the arrowhead strikes dense matter such as a substantial bone within the target, thus reducing the amount of penetration and wounding inflicted upon the target. Ulmer, as one means of addressing this problem, designed the blades to interlock with each other so that the blades could pivot with respect to the ferrule, allowing the blades to move out of the way of obstructions within the target. This design, however, limits the ability to avoid obstructions to one means of responsiveness.

A primary objective of this invention is to provide a broadhead arrow tip with blades which can independently move to avoid obstructions in multiple ways, thus increasing the amount of penetration and wounding inflicted upon a target. The inventor has developed a way to achieve this through widening the slot in the ferrule to allow the blades to move and/or tilt more freely in response to obstructions within the target. The slot in ferrule bodies of the prior art to date are generally sized to be slightly larger than the thickness of the blades held within the slot, thus restricting movement afforded to the blades, as U.S. Pat. No. 5,458,341 to Forrest et al. and U.S. Pat. No. 5,857,930 to Troncoso show.

BRIEF DESCRIPTION OF THE DRAWINGS

The features of the invention will now be described with reference to the drawings of a preferred embodiment, which are intended to illustrate and not limit the invention.

SUMMARY OF THE INVENTION

A broadhead arrow tip with independent suspension expandable blades is disclosed. The arrow tip has an elongated ferrule body with a first slot oriented lengthwise therein which bifurcates the front end into two portions. A second slot oriented lengthwise within the body is situated between the first slot and the body's back end. The second slot is open to the body's side surfaces and is transversely wider than the first slot. Expandable blades are independently suspended within the second slot by a retaining pin passing through oblong apertures through an end of the blades. The blade ends have a thickness of one-third or less than the transverse width of the second slot. A threaded tip is securable on a threaded surface at the body's front end. Securement of the tip deflects the front portions toward one another, narrowing the first slot which holds the blades in a stowed positioned when placed therein.

DETAILED DESCRIPTION OF A PREFERRED EMBODIMENT

A detailed description of a preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
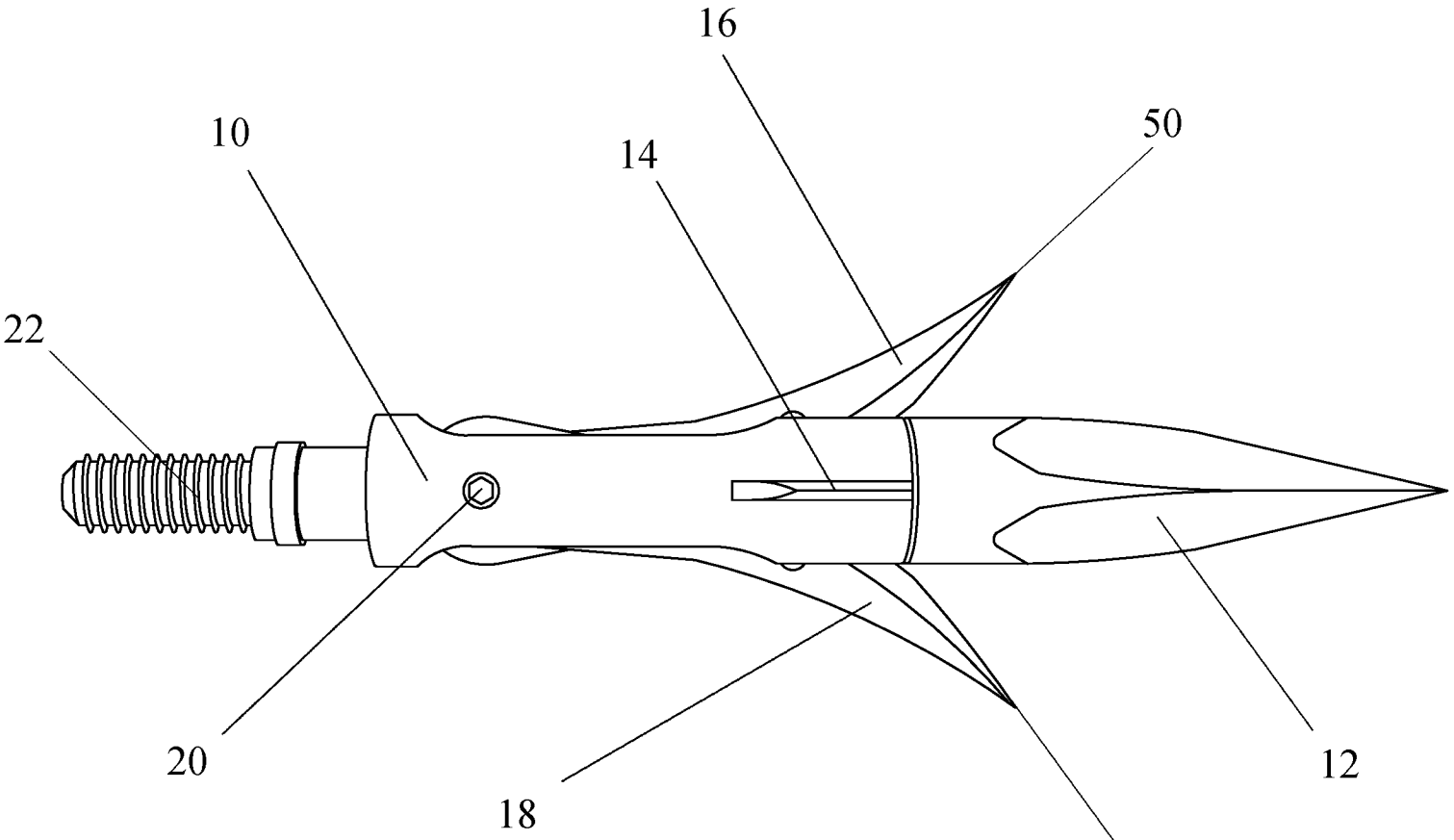
FIG. 1 is a top view of a preferred embodiment of an expandable broadhead arrow tip according to the invention.
Figure 2:
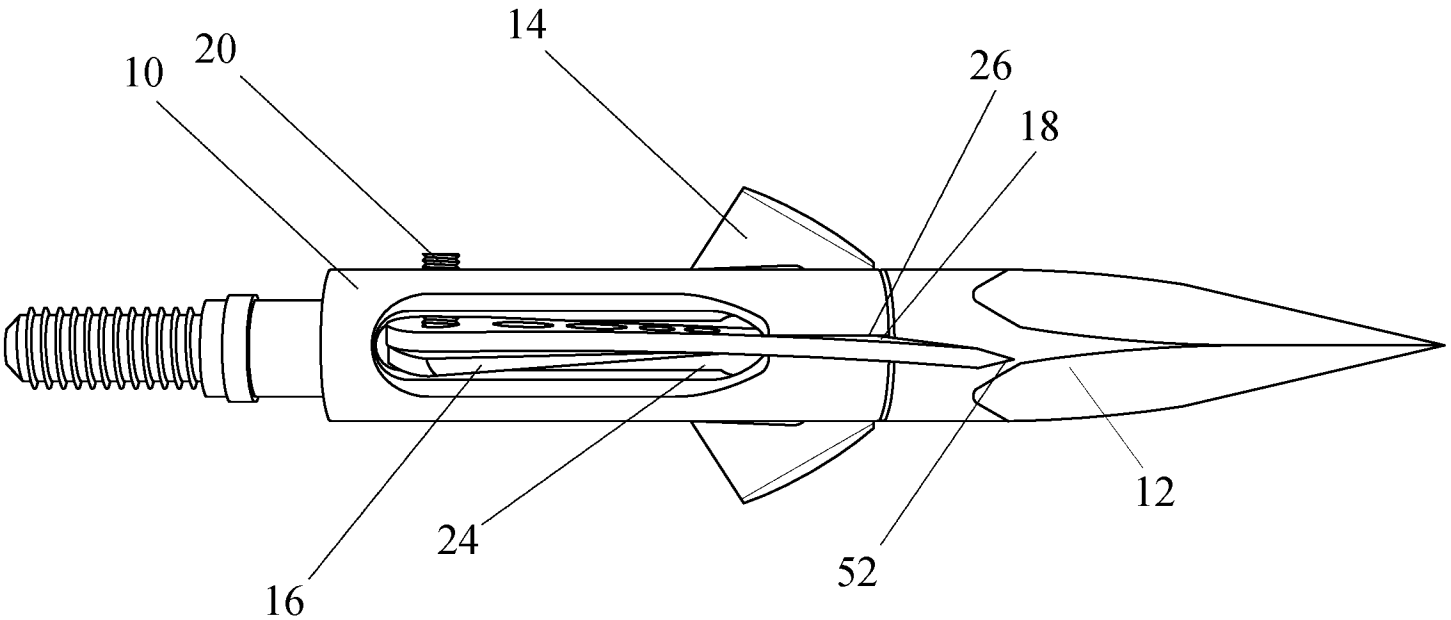
FIG. 2 is a side elevation view of FIG. 1.

Turning now in detail to the drawings of FIGS. 1-10, therein illustrated is an expandable broadhead arrow tip embodying the invention. The arrow tip shown in FIG. 1 generally comprises elongate ferrule body 10, threaded tip 12, stationary blade piece 14, expandable cutting blades 16 and 18, threaded fastener retaining pin 20 and threaded end 22 for fastening to an arrow shaft (not shown). FIG. 2 shows ferrule body 10 is slotted lengthwise (24) to receive expandable blades 16 and 18.

Figure 4:
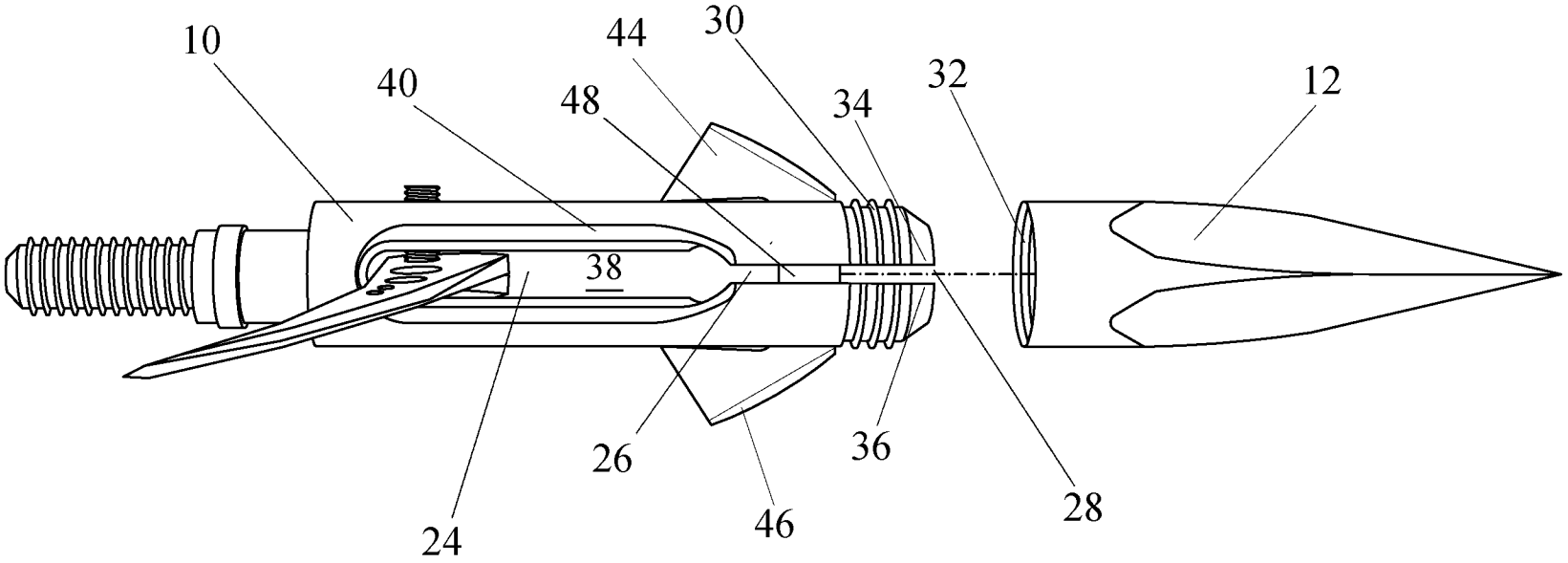
FIG. 4 is a side elevation view of FIG. 3 with its tip removed.
Figure 6:
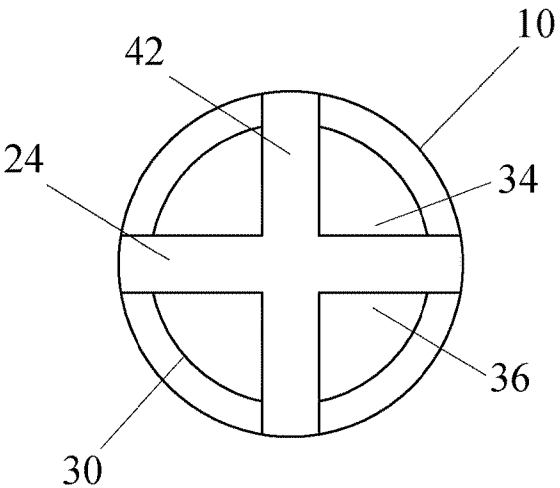
FIG. 6 is an enlarged, front-end elevation view of the ferrule body of the arrow tip of FIGS. 1-4.
Figure 7:
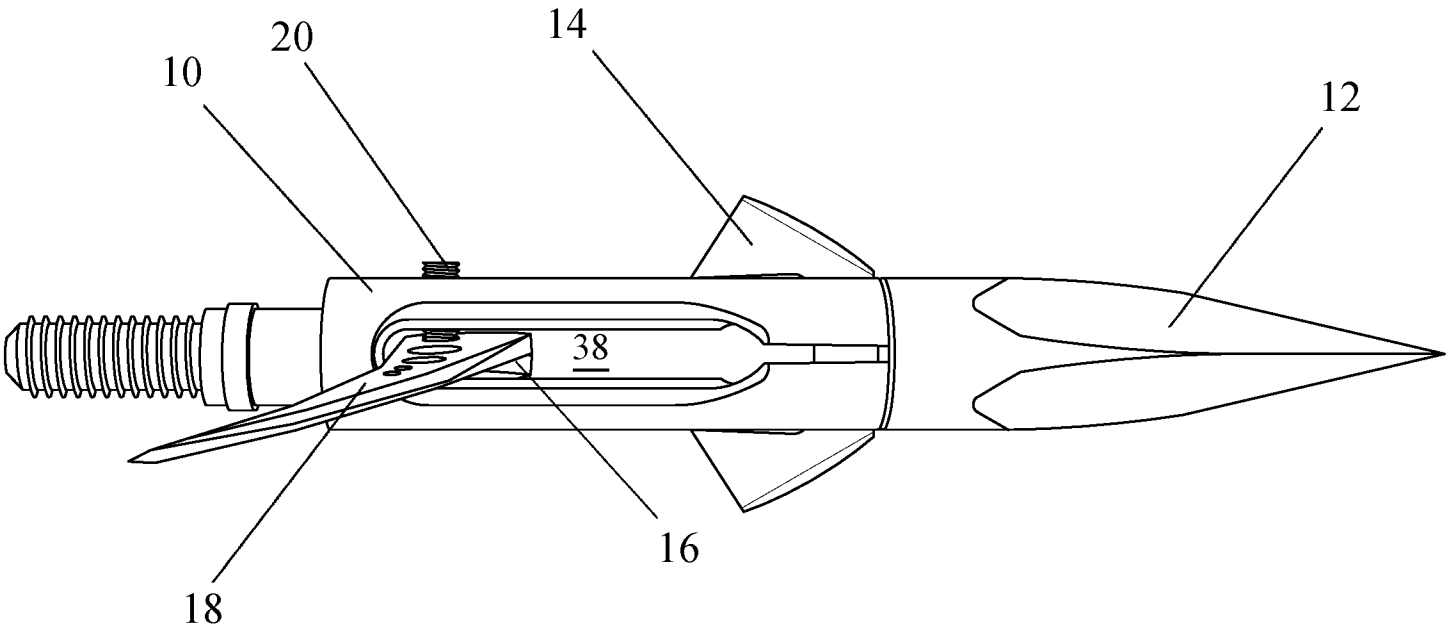
FIG. 7 is a side elevation view of FIG. 3.

Ferrule body 10 has several different features which contribute to operation of the arrow tip. FIGS. 4 and 6 show its front end is narrowly slotted (26) to an open end (28) which allows narrow slot portion 26 to pinch down on stowed expandable blades 16 and 18 when threaded tip 12 is fastened onto thread area 30 as is shown in FIGS. 1 and 2. Threaded end 32 (FIG. 4) of tip 12 is sized slightly smaller than threaded area 30 of body 10 to cause upper section 34 and lower section 36 to deflect toward one another as threaded end 32 is screwed on to threaded area 30. For example, in an application where the general outer diameter of ferrule body 10 is about 7.9 mm; outer diameter of threaded area 30 is about 5.8 mm; and narrow slot portion 26 is about 1.1 mm wide, threaded end 32 is about 5.4 mm wide. Blades 16 and 18 have a thickness of about 0.9 mm in this example. The smaller size of threaded end 32 deflects sections 34 and 36 toward one another which reduces the width of narrow slot portion 26 such that it has an interference-type fit with expandable blades 16 and 18 when in a stowed position as shown in FIGS. 1 and 2. This creates a pinching action as shown in FIG. 2 which maintains blades 16 and 18 in a stowed position prior to use and while in flight. Retention of the blades by the pinching action dispenses with the need of using rubber bands or plastic collars or brackets to keep the blades from opening during flight.

Figure 3:
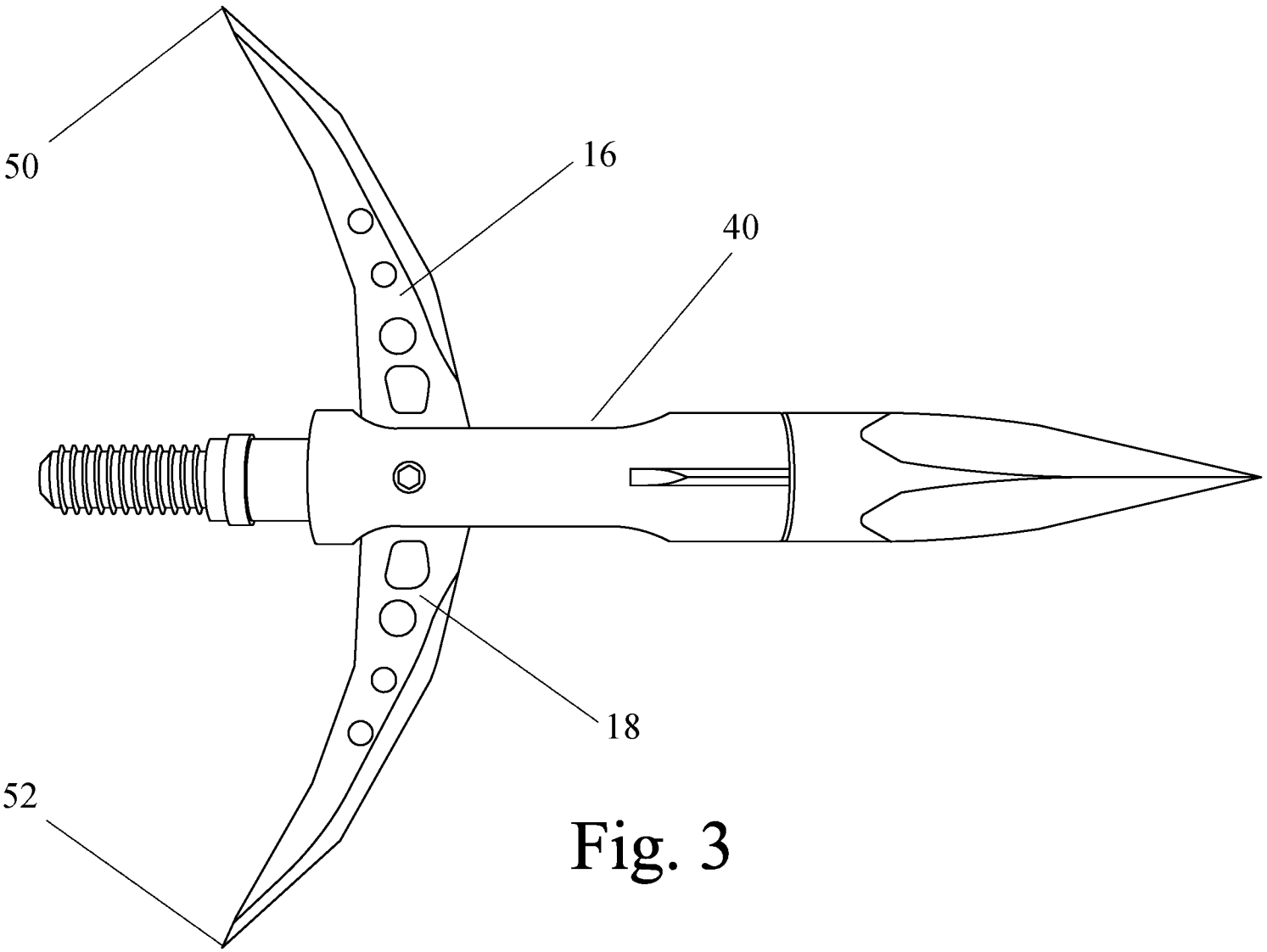
FIG. 3 shows the arrow tip of FIGS. 1 and 2 with its blades swung open into an open, expanded position.
Figure 8:
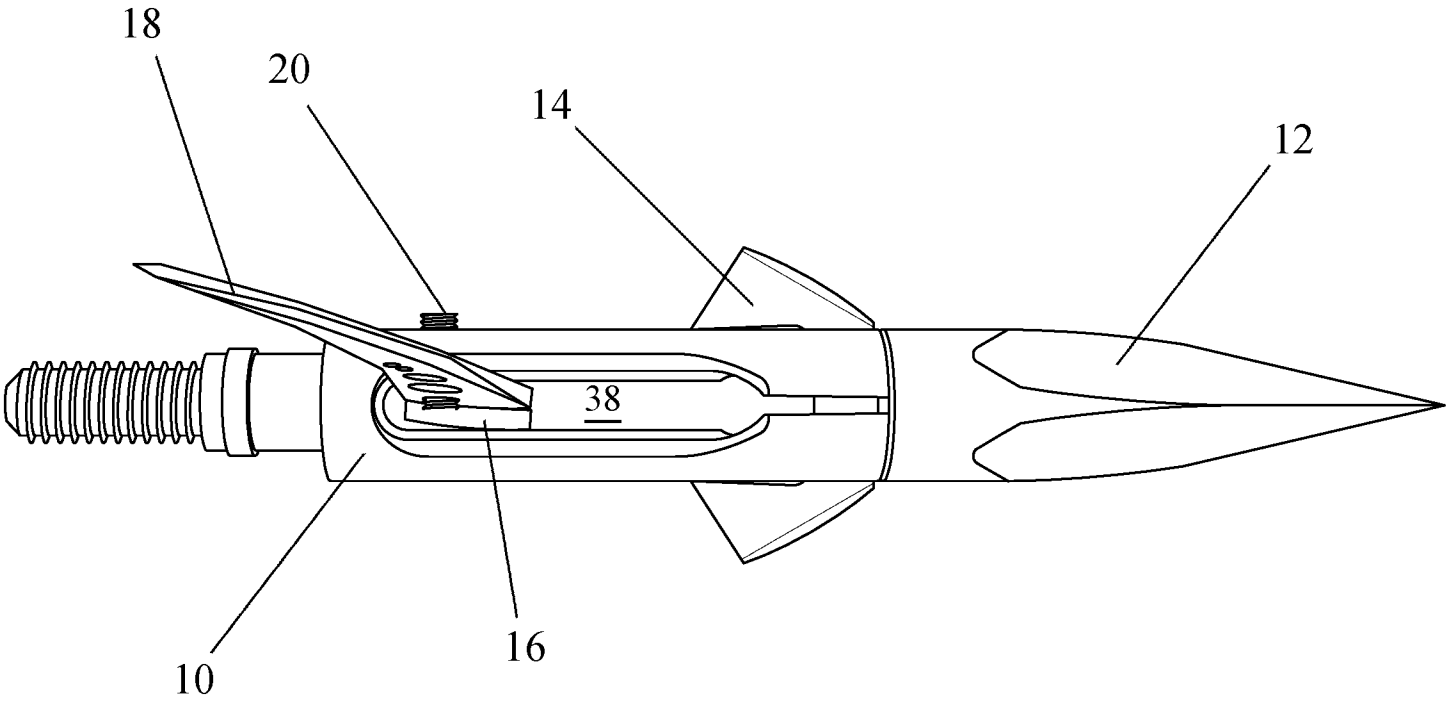
FIG. 8 shows how the blades are capable of laterally tilting within the slotted ferrule.
Figure 9:
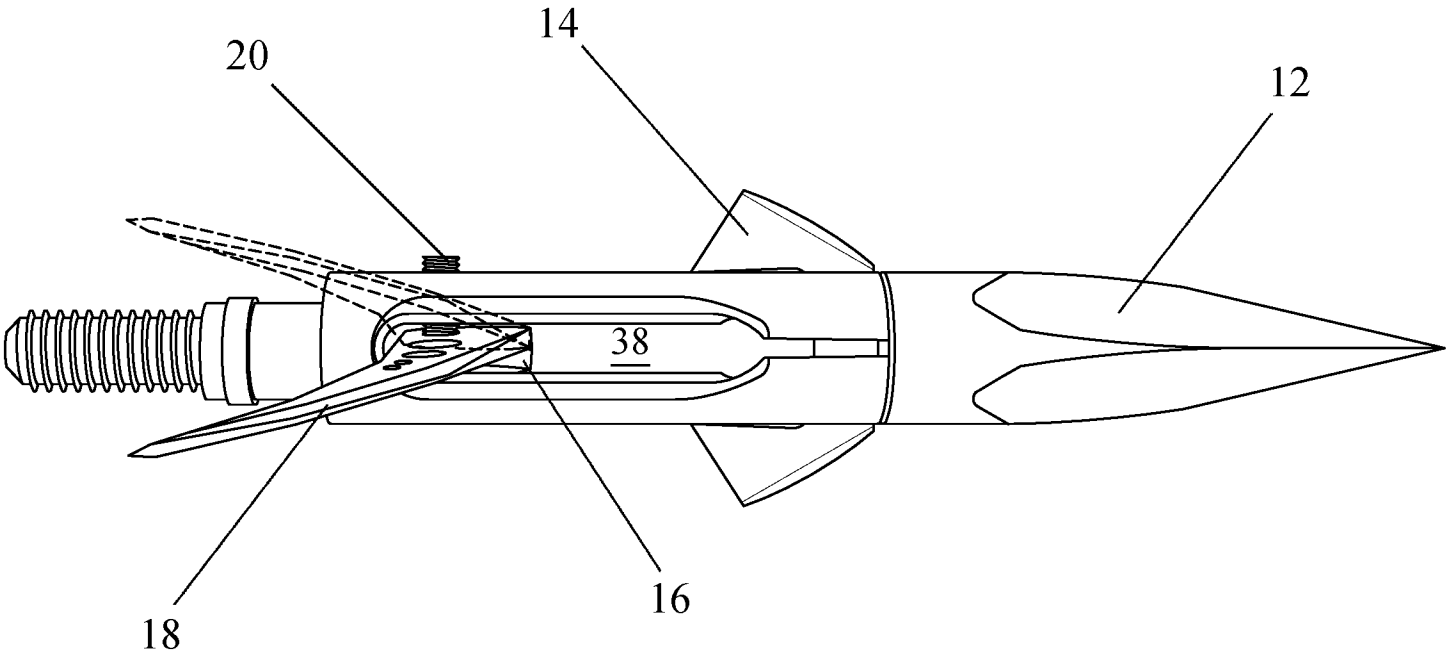
FIG. 9 illustrates the blades in phantom lines to show an alternate position of the blades.
Figure 10:
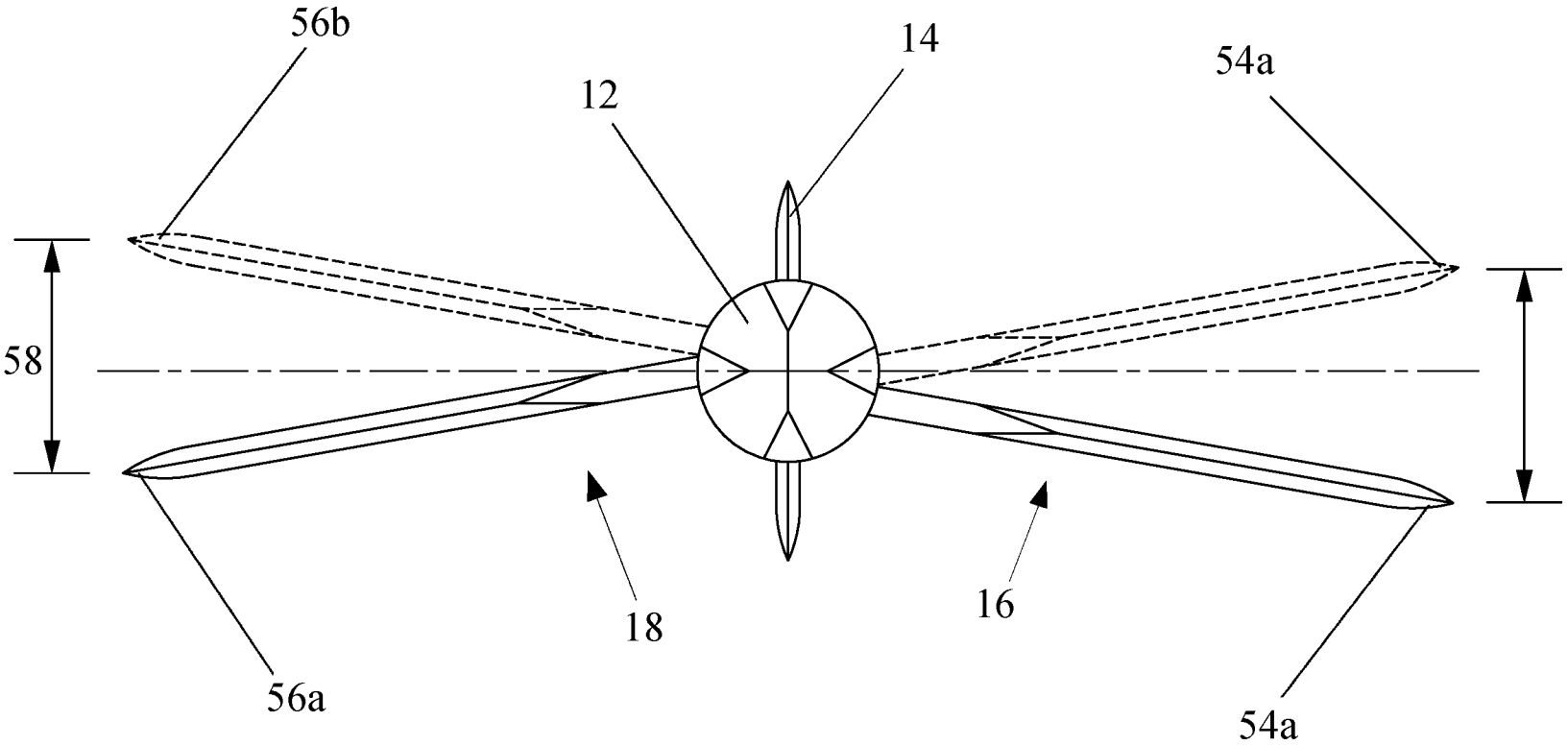
FIG. 10 is a front-end view which illustrates range of movement of the blades.

The shape of slot 24 widens transversely (38; FIG. 4) to provide freedom of movement to blades 16 and 18 as shown in FIGS. 8-10 once they've been deployed as shown in FIG. 3. Wide slot area 38 is also chamfered (40) to provide more free range of motion to expandable blades 16 and 18 once deployed. Wide slot area 38 has general dimensions of about 2.9 mm wide by about 19.7 mm long and chamfer 40 is angled at about 20 degrees in the example application detailed above.

FIG. 6 shows the front end of body 10 is also slotted (42) crosswise from narrow slot portion 26 (see FIG. 4) to receive one-piece stationary blade 14 as shown in FIG. 4. Upper blade 44 is connected to lower blade 46 by crosspiece 48 which seats in crosswise slot 42.

Figure 5:
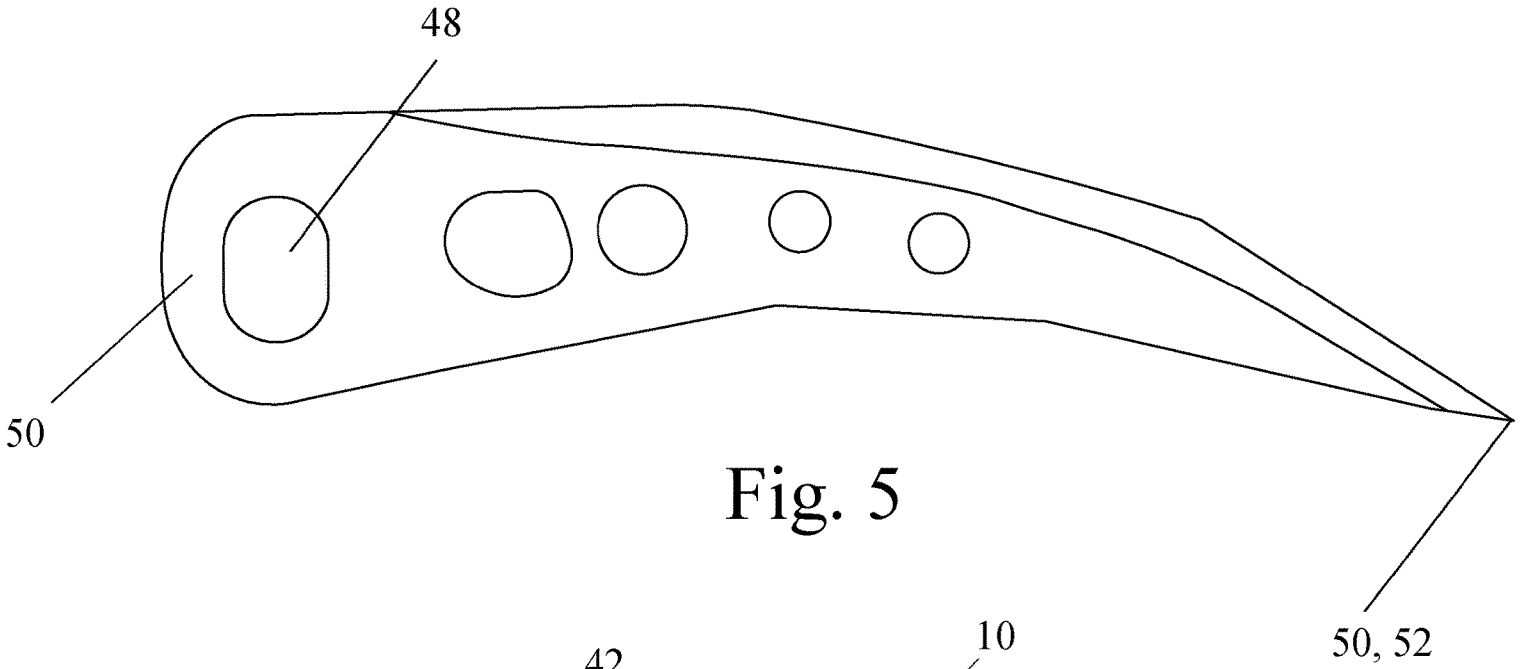
FIG. 5 is an enlarged view of the expandable blade of the arrow tip of FIGS. 1-4.

Blades 16 and 18 are independently suspended from one another by being individually retained by threaded fastener retaining pin 20. FIG. 5 shows each blade has an oblong hole or aperture 48 through suspended end 50. Oblong hole 48 has general dimensions of about 3.4 mm by about 2.4 mm and retaining pin 20 has a diameter of about 1.8 mm in the example application detailed above. Outer tips 50 and 52 of blades 16 and 18 rotate the blades open as the arrow tip strikes a target until they are fully expanded as shown in FIGS. 3-4. FIGS. 7-10 show how blades 16 and 18 are free to move and tilt on retaining pin 20 once the expandable blades have swung open. Suspended ends 50 are independently retained by retaining pin 20 such that each blade may move or tilt independent from one another. That is, blade 16 (FIG. 10) is free to move between position 54*a* and 54*b* (shown in phantom line) independently from the movement of blade 18 which is free to move between position 56*a* and 56*b*. Distance 58 between positions 54*a*, 56*a* and 54*b*, 56*b* is about 8.3 mm in the example application detailed above. The transverse width of wide slot area 38 also allows the blades to tilt transversely to the longitudinal axis of body 10 as well.

The independent suspension of blades 16 and 18 on retaining pin 20 allow each blade to react individually to obstructions within the target which allows each blade to individually stay open from the ferrule as much as possible, contributing to the tip making as wide a cutting diameter as possible. Individual responsiveness of the blades is a substantial improvement over prior art designs. For example, the prior art design shown in U.S. Pat. No. 8,128,521 to Ulmer locks the blades together which only allows a blade striking an obstruction to respond by moving back into the ferrule which in turn reduces the cutting diameter of the tip.

While the invention has been described in connection with a preferred embodiment, it is not intended to limit the scope of invention to the particular form(s) set forth, but on the contrary, it is intended to cover such alternatives, modifications, and equivalents as may be included within the spirit and scope of the invention as defined by the patent claims.

What is claimed is:

1. A broadhead arrow tip with independent suspension expandable blades, comprising:

an elongated ferrule body defined by a front end, rear end, and side surfaces therebetween;

a first slot oriented lengthwise within said body, said first slot open to said front end and said side surfaces, and bifurcating said front end of said body into two front end portions;

a second slot oriented lengthwise within said body and situated between said first slot and said rear end of said body, said second slot open to said side surfaces and transversely wider than said first slot;

first and second expandable blade members, each with an end thereof having a thickness of one-third or less than said transverse width of said second slot;

an oblong aperture through each of said ends of said first and second blade members;

a retaining pin within said second slot independently suspending said ends of said blade members within said second slot by said oblong apertures, wherein said oblong apertures are sized with respect to said retaining pin to allow said blade members to independently move, tilt and swing about said retaining pin;

a threaded surface at said front end of said body; and a threaded tip threadedly securable to said threaded surface, wherein threaded securement of said tip to said threaded surface deflects said front end portions toward one another narrowing said first slot to hold said blade members in a stowed position when placed therein.

* * * * *